United States Patent [19]

Smith

[11] 4,254,547

[45] Mar. 10, 1981

[54] METHODS AND APPARATUS FOR AUTOMATIC JUMPER PLACEMENT

[75] Inventor: Arnold R. Smith, Chester, N.J.

[73] Assignee: Bell Telephone Laboratories, Incorporated, Murray Hill, N.J.

[21] Appl. No.: 30,751

[22] Filed: Apr. 17, 1979

[51] Int. Cl.[3] ..... H01R 43/00

[52] U.S. Cl. ..... 29/857; 29/749; 29/748; 226/162; 414/589; 414/749; 242/7.18

[58] Field of Search ..... 29/628, 33 M, 739, 741, 29/564, 749, 753, 566.3, 759; 339/97 P, 98; 414/589, 591, 749; 226/109, 162, 115, 156; 242/7.18, 7.17, 7.09; 140/93 R, 92.1

[56] References Cited

U.S. PATENT DOCUMENTS

| | | | |
|---|---|---|---|
| 2,862,671 | 12/1958 | Dimond | 242/7.18 |
| 3,919,503 | 11/1975 | Friedrichsen et al. . | |
| 3,972,101 | 8/1976 | Casey et al. . | |
| 3,978,291 | 8/1976 | Bergeron, Jr. et al. . | |
| 4,066,317 | 1/1978 | Bierenfeld et al. | 339/98 X |
| 4,101,189 | 7/1978 | Moser et al. | 339/99 R |
| 4,117,585 | 10/1978 | Smith . | |
| 4,126,935 | 11/1978 | Rhines . | |
| 4,150,867 | 4/1979 | Knickerbocker | 339/97 P |

*Primary Examiner*—Francis S. Husar
*Assistant Examiner*—C. J. Arbes
*Attorney, Agent, or Firm*—Robert O. Nimtz

[57] ABSTRACT

A telephone central office main frame system is disclosed in which jumper wire terminations are placed by an automatic mechanism in response to control signals. The terminals are laid out in vertical lines having troughs therebetween in which the jumper wires lie. By alternating rows of input and output terminals, a large degree of flexibility of interconnection is obtained. In particular, a rotating pick-up head secures a twisted jumper wire pair from a reel source, automatically terminates one end of the wire pair in one set of preselected terminals, runs the jumper wires through the trough to the vicinity of the other terminals and, finally, automatically terminates the other ends in the preselected terminals.

18 Claims, 15 Drawing Figures

METHODS AND APPARATUS FOR AUTOMATIC JUMPER PLACEMENT

BACKGROUND OF THE INVENTION

1. Field of the Invention

This invention relates to automatic main distributing frames and, more particularly, to automated apparatus for placing jumper wires between terminal connectors on such main frames.

2. Description of the Prior Art

Due to the high costs involved in the maintenance and operation of main distributing frames in telephone wire centers, there is an increasing interest in automating such maintenance and operation. One such automatic main frame system is shown in H. J. Friedrichsen et al U.S. Pat. 3,919,503, granted Nov. 11, 1975, and R. F. Bergeron et al U.S. Pat. No. 3,978,291, granted Aug. 31, 1976. This system utilizes automated mechanical actuators under computer control for establishing and terminating crossconnections on pinboard switches, thereby setting up and terminating electrical paths through the system. This system requires expensive printed wire pinboards as well as a mechanism for inserting and retracting the pinboards from receptacles in the main frame. Moreover, the pinboard arrangement permits cross-connections between only limited pairs of different terminations. This limited pairs of different terminations. This limited connectability of terminations, in turn, requires complicated switching networks (as shown in FIG. 2 of the Bergeron et al patent) in order to provide adequate connectability between a large number of input and output terminals.

SUMMARY OF THE INVENTION

In accordance with the illustrative embodiment of the present invention, interconnections between terminals on a main distributing frame are accomplished using simple jumper wires such as are used in the prior art manual systems. The placement of these jumper wires, however, is automated by utilizing a rotating wire pick-up head to pull jumper wires from a wire source to a position suitable for terminating one end of the wires in a first pair of insulation-piercing connectors, using an articulated presser head. The jumper wires are then inserted into a wire trough and payed out in the trough to the location of an identical second pair of connectors at the other end of the termination. The wires are cut, the free wire ends placed in the proximity of the lower wire-piercing connectors by means of the pick-up head, and a presser head used to lock this end of the jumper wires into the connectors.

The wire pick-up head, trough routing, wire cutting and connector terminating tools are carried on a moving platform which moves along the trough adjacent to or between lines of terminating connectors. A second platform carries the wire source and pair-indexing tool. These platforms, in turn, are mounted on a roving actuator which moves along the face of the main distributing frame to locate the platforms in the vicinity of the appropriate trough. Both the actuator and the platforms are moved in response to control signals which may be generated in a digital computer in response to requests for interconnections between pre-identified connectors.

In accordance with one feature of the illustrative embodiment, jumper wires in a twisted pair configuration are used for making interconnections. A spinning index head, interposed between the wire source and the wire handling tools, is used to uniquely index the members of the twisted pairs.

In accordance with another feature of the illustrative embodiment, slotted-beam connectors are mounted in lines of connector blocks which may be placed back-to-back to provide adjacent terminal strips and simultaneously define a wire trough between adjacent pairs of back-to-back terminal strips.

DETAILED DESCRIPTION

Figure 1:
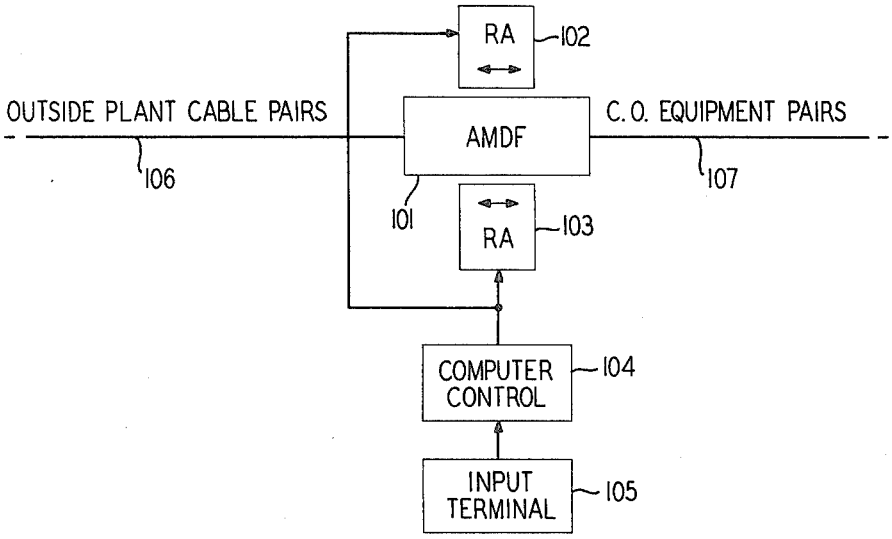
FIG. 1 is a general block diagram of an automated main distributing frame system which may incorporate automatic jumper placement apparatus in accordance with the present invention.

FIG. 1 is a block diagram representation of an automated main distributing frame (AMDF) system comprising main distributing frame 101 and a pair of roving actuators 102 and 103 suitable for moving across opposite faces of frame 101 to automatically place jumper wire connections on frame 101. Roving actuators 102 and 103 are under the control of a computer system 104, which in turn is directed by an input terminal 105. When directed by input terminal 105, the computer control 104 directs roving actuator 102 or actuator 103 to place a pair of jumper wires between the terminations of a pair of outside plant cable wires 106 and a pair of central office equipment wires 107. As will be described in detail hereinafter, these interconnections are made by automatically terminating a twisted pair of jumper wires at vertically displaced connector pairs on one of the faces of frame 101. Terminal 105 can comprise any keyboard terminal and is used to initiate the interconnection activity. Cable pairs 106 are terminated within frame 101 on the back ends of certain of the connector pairs while equipment pairs 107 are terminated on the back ends of other connector pairs.

Figure 2:
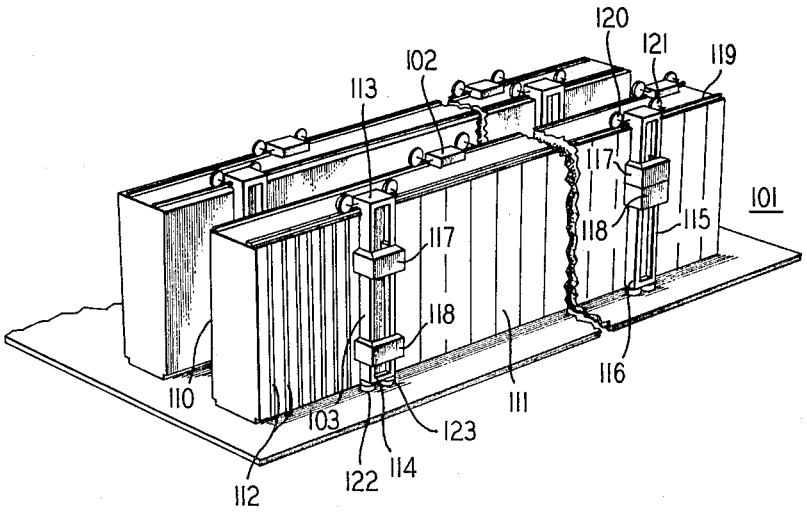
FIG. 2 is a perspective view of a main distributing frame in accordance with the present invention.

As can be seen in the perspective view of FIG. 2, the main distributing frame 101 has two faces 110 and 111. Each face of frame 101 includes a plurality of vertical terminal strips 112 on their outer surfaces and wire connection fields, such as solderless wrap terminals, on their inner surfaces. Roving actuators 103 each comprise a top support member 113 and bottom support member 114 joined by two vertical column members 115 and 116. Mounted on column members 115 and 116 are a platform 117 and a platform 118. Platform 117 includes the jumper placement mechanism, while platform 118 includes a jumper wire source and feed mechanism. Platforms 117 and 118 can be moved both horizontally and vertically with respect to face 111 to position them in the vicinity of a particular connector pair on a selected one of strips 112 to which connections are to be established. Horizontal movement is obtained by moving the entire actuator 103 along face 111 and vertical movement is obtained by independently moving platforms 117 and 118 up and down on column members 115 and 116.

Along the top of frame 101 there is attached a guideway 119. Top support member 113 includes two wheels 120 and 121 which ride in guideway 119 to provide accurate horizontal tracking and support for actuator 102. Wheels 120 and 121 are driven by apparatus (not shown) to move actuator 103 horizontally along guideway 119. A guide may also be located along the bottom of face 111 which mates with rollers 122 and 123 to provide guidance, control and stability to actuator 102. Platforms 117 and 118 include drive mechanisms to permit platforms 117 and 118 to be moved up and down on columns 115 and 116. Both the horizontal movement of actuator 103 and the vertical movement of platforms 117 and 118 are under the control of signals from computer 104 in FIG. 1. Thus, actuator 103 can be positioned anywhere along the face of frame 101 and platforms 117 and 118 moved to any position along the vertical connector strips 112. These roving actuator arrangements are described in detail in the aforementioned Bergeron et al patent and will not be further described here. A plurality of roving actuators can be used on each face of frame 101, depending on its length. The control computer 104 then prevents interference between actuators by assigning jumper placements to the actuators at sufficiently separated horizontal locations on the face of frame 101.

Figure 3:
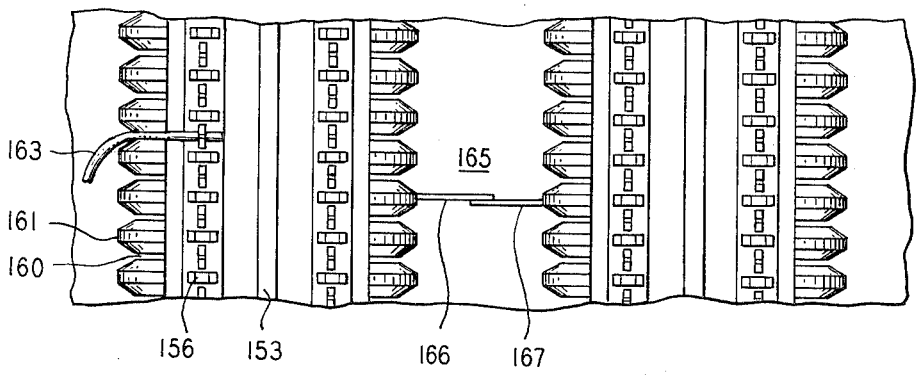
FIG. 3 is a partial plan view of two adjacent connector strips on the face of the main distributing frame of FIG. 2.
Figure 4:
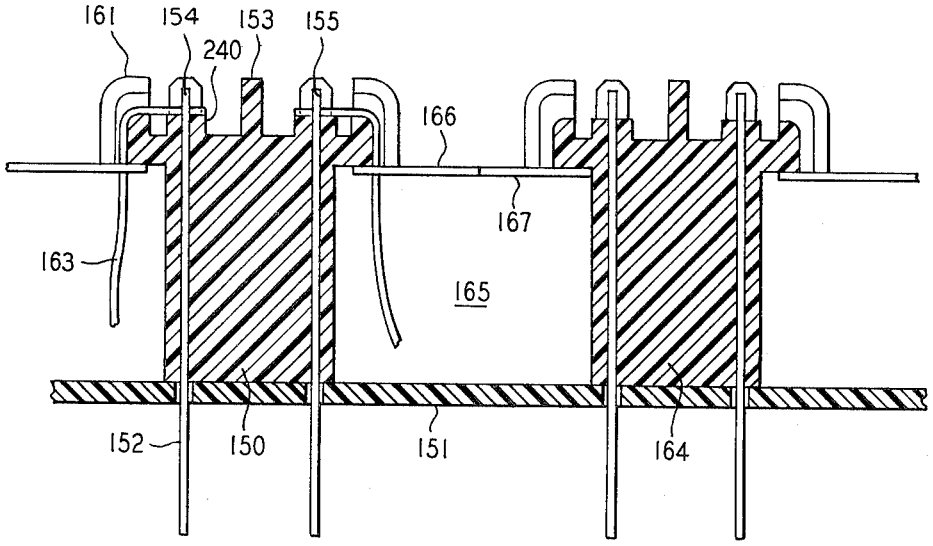
FIG. 4 is a sectional elevation view of the connector strips of FIG. 3.
Figure 5:
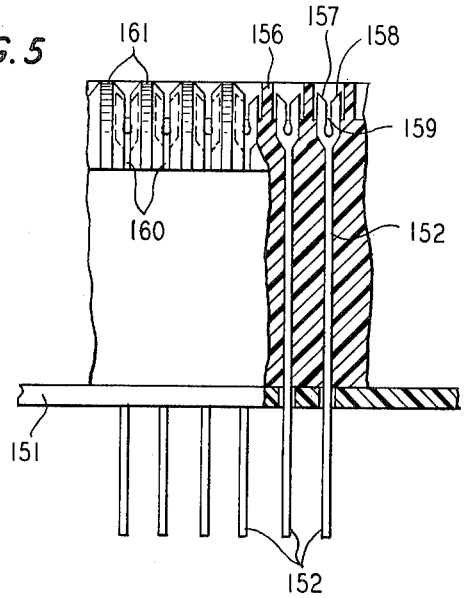
FIG. 5 is a partially sectional side view of the connector strips shown in plan view in FIG. 3.

FIGS. 3, 4 and 5 are a plan view, an elevation view and a side view, respectively, of the connector strips 112 on the faces 110 and 111 of main distributing frame 101 in FIG. 2. As shown in FIG. 4, the central body portion 150 of a connector block comprises insulating material mounted on an insulated backplate 151 and molded around conductive connectors 152, providing solderless wrap posts at one end and slotted-beam connector portions at the other end. The insulated body 150 is molded so as to form on its outer surface (with respect to frame 101) an insulated barrier 153 separating two symmetrical line-ups 154 and 155 of slotted-beam connectors separated by insulated divider 156. As can be better seen in FIG. 5, the connectors 152 include at their outer end a pair of conductive contact members 157 and 158 having tapered upper edges to guide an insulated wire to oppositely disposed knife-edge portions 159 which pierce the insulation and make electrical contact with the interior wire.

Also molded into the top portion of insulated body 150 are a plurality of strain relief grooves 160 separated by guiding barriers 161. The grooves 160 are aligned with the central portion 159 of the slotted-beam connectors 152 such that a wire, such as wire 163, is aligned with insulation-piercing edges 159 when lying in slot 160. Barriers 161 have tapered outer portions to guide the wires to slots 160.

Adjacent connector blocks, such as blocks 150 and 164 in FIG. 4, define therebetween a trough 165 suitable for carrying a plurality of wires extending between the various connectors on the connector blocks. Pairs of retaining springs 166 and 167 retain the wires in trough 165 and yet permit insertion of wires by permitting resilient bending of the strips away from each other. Retaining strips 166 and 167 are repeated at regular intervals along the length of trough 165.

Returning to FIG. 2, the face of the main distributing frame, such as face 111, comprises a large plurality of vertical connector block strips, such as those shown in FIGS. 3 through 5. Interconnections are made on the face of frame 101 by connecting a pair of terminals on one of the connector blocks to a terminal pair on the next adjacent connector block (or on the same connector block). The wire wrap terminals 152, extending through the backplate 151 of the connector block, form a field to which the cable pairs from the outside plant equipment and central office equipment, respectively, can be connected. It may also be desirable to wire selected conductive connectors 152 together on the backplane of frame 101 in order to multiply the appearances of these terminations for multiple connections.

Figure 6:
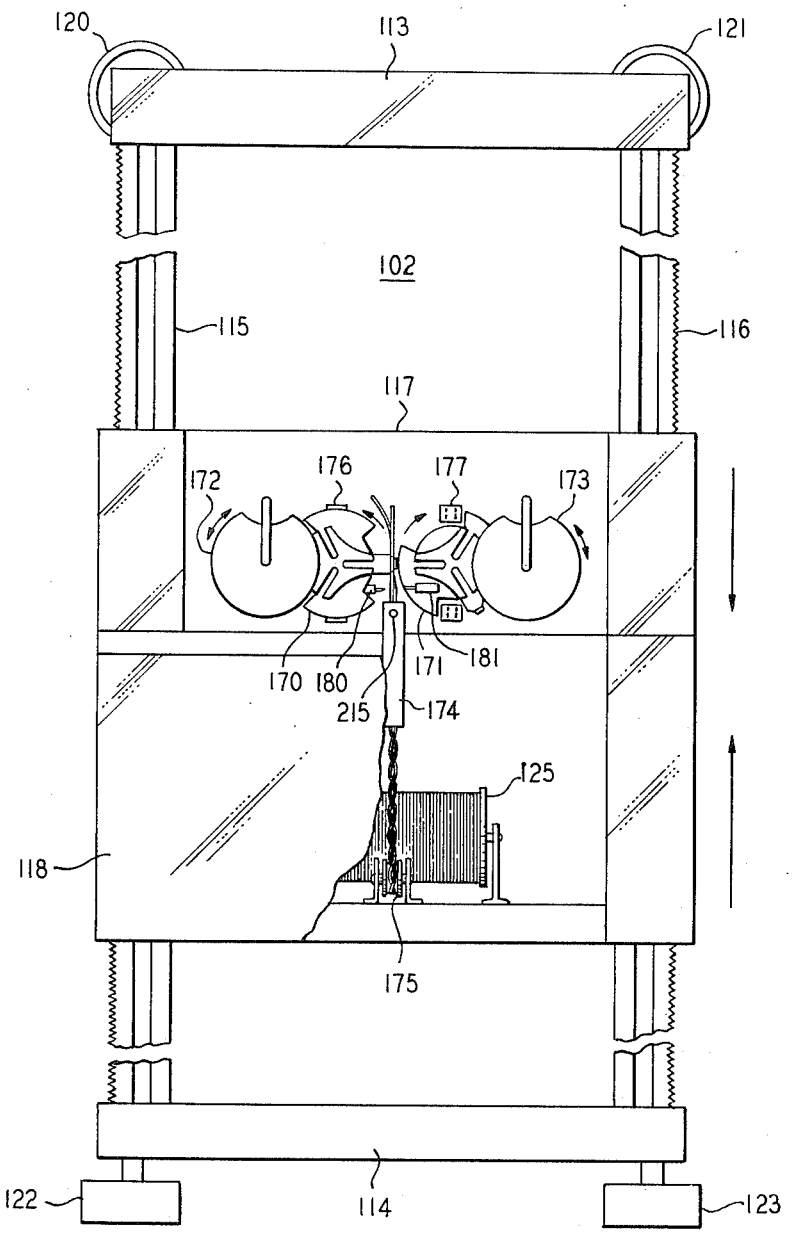
FIG. 6 is an elevation view of the roving actuator shown in FIGS. 1 and 2.

In accordance with the illustrative embodiment of the present invention, automatic means are provided for making interconnections between the slotted-beam end of connectors 152 in order to complete interconnections between outside plant cable terminations and telephone central office switching equipment terminations. To this end, and as shown in FIG. 6, the roving actuator 102, shown in perspective view in FIG. 2, includes a platform 117 having two oppositedly disposed wire placement heads 170 and 171, driven by driver wheels 172 and 173, respectively. Wire placement heads 170 and 171 clamp onto twisted pair wire ends from an indexing head 174 affixed to platform 118 and fed through a guide pulley 175 from supply reel 125. Indexing head 174 presents the members of the twisted pair in a preselected orientation in order to insure proper identification of the two wires of the pair (e.g., the tip and ring conductors of a telephone circuit) during the automatic termination procedure. Vertically movable platforms 117 and 118 are brought together so that one of pick-up heads 170 or 171 is able to clamp the wires protruding from indexing head 174. Together, platforms 117 and 118 move to the vicinity of the lower pair of connectors to be interconnected. Then, by moving platform 117 upward, a length of twisted wires is laid out along the top of the trough 165 (FIG. 4). Platform 117 stops its vertical movement in the vicinity of the upper pair of connectors to which the connection is to be made.

The pick-up head (170 or 171) on platform 117 rotates one-third of a revolution to present the wires between presser-cutter head 176 or 177 and a pair of slotted-beam connectors such as connector 152 in FIG. 5. The presser-cutter head 176 or 177 then moves toward the slotted-beam connectors to force the wires of the pair into the aligned slotted-beam apertures, thereby making a connection at the upper end. At the same time, the unused ends of the twisted pair are cut off. At this time, a guiding tool 179 grasps the twisted wire pair and forces it down into trough 165 and locking the wires in strain relief grooves 160 (FIG. 4). Platform 117 is now free to move downward to the vicinity of the lower jumper connection, during which downward movement guiding tool 179 forces the twisted pair through the retaining springs 166 and 167 into trough 165.

Platform 117 stops its downward movement in the vicinity of the lower connectors to which a connection is to be made, guiding tool 179 releases the wires, retracts, and head 170 (or head 171) picks up the ends of these wires at indexing head 174. Platform 118 then moves a short distance downward to pull a short length of jumper wires from indexing head 174. A pair of oppositely disposed cutting edges 180 and 181 are then operated to sever the twisted pair, leaving a short length protruding from indexing head 174 to be picked up on the next jumper placement cycle. The wire placement head 170 or 171, by a one-third rotation, presents these wires to the lower slotted-beam connectors. Presser-cutter tool 176 (or 177) again descends to complete the connection at this end and cut off any surplus wire.

The cutting tools 180 and 181 are mounted on platform 117 and are activated to cut the twisted pair just prior to placement of the lower end of the jumper connection. In this way, the indexing head 174 again becomes available to feed wires for the next connection. Actuator 102 can therefore move along the face of frame 101 to the connector block line at which the next connection is to be made and repeat the above operations.

Figure 7:
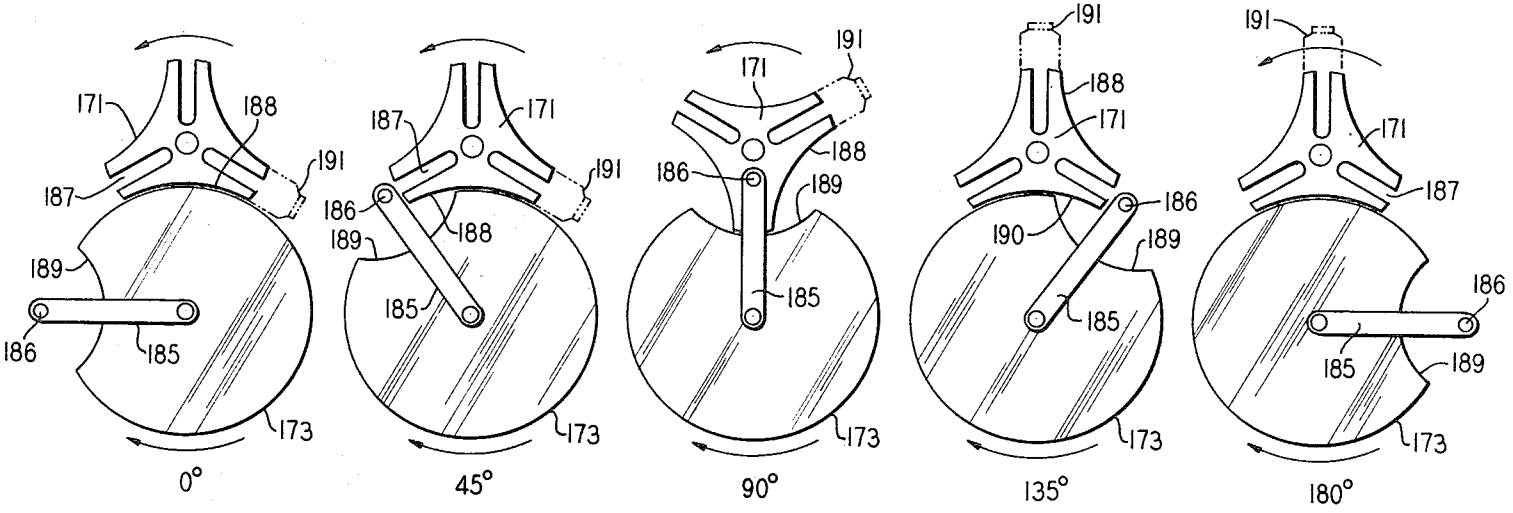
FIG. 7 is a schematic view of the geneva movement for rotating the wire pick-up head to the various positions.

In FIG. 7 there is shown a schematic diagram of the geneva movement by means of which driver wheel 173 rotates wire placement head 171 by a third of a revolution, into and out of the wire pick-up position. The positions shown in the drawing show wheel 173 in successive rotational positions from zero degrees to 180 degrees in 45-degree steps. Proceeding from left to right, driver wheel 173 includes a driver arm 185 having a driver pin 186 extending outwardly toward placement head 171. The location of pin 186 is such that pin 186 engages a groove 187 in placement head 171 when driver wheel 177 is rotated clockwise. The outer periphery of driver wheel 173 engages a mating surface 188 on placement head 171 and prevents head 171 from rotating until, as shown at 45 degrees, pin 186 engages groove 187. Once pin 186 engages groove 187, placement head 171 is free to rotate counterclockwise due to the arc-shaped cutout 189 in driver wheel 173. As can be seen at 90 degrees, the pin 186 slides in groove 187 to the end of groove 187 as placement head 171 rotates to the position shown at 90 degrees. Driver head 173 continues to rotate clockwise and pin 186 continues to rotate placement head 171 to the position shown at 135 degrees where the outer periphery of driver wheel 173 engages the surface 190 of placement head 171 to maintain placement head 171 in the position shown. At 180 degrees the geneva movement is completed and placement head 171 is oriented to present jaw portion 191 in a position to pick up wires from indexing head 174 in FIG. 6.

Driver wheel 173 can continue to rotate clockwise, eventually again engaging slot 187 on placement head 171 advancing head 171 a third of a revolution (120 degrees) for every complete rotation of driver wheel 173. Moreover, driver wheel 173 can rotate either clockwise or counterclockwise and thereby advance placement head 171 in either direction. The three orientations of placement head 171 correspond to a wire pick-up position (shown at 180 degrees) and two wire placement positions, one for the top connection and one for the bottom connection. It will be further noted that the wire placement position for the upper termination connection requires clockwise rotation while the position for the lower termination connection requires a counterclockwise rotation. That is, placement head 171 turns clockwise to position the wires for the upper termination and turns counterclockwise to place the wires for the lower termination. Driver wheel 173 is, of course, under the control of the computer 104 of FIG. 1 to insure that the appropriate movements are made at the appropriate times during the jumper placement cycle.

Figure 8:
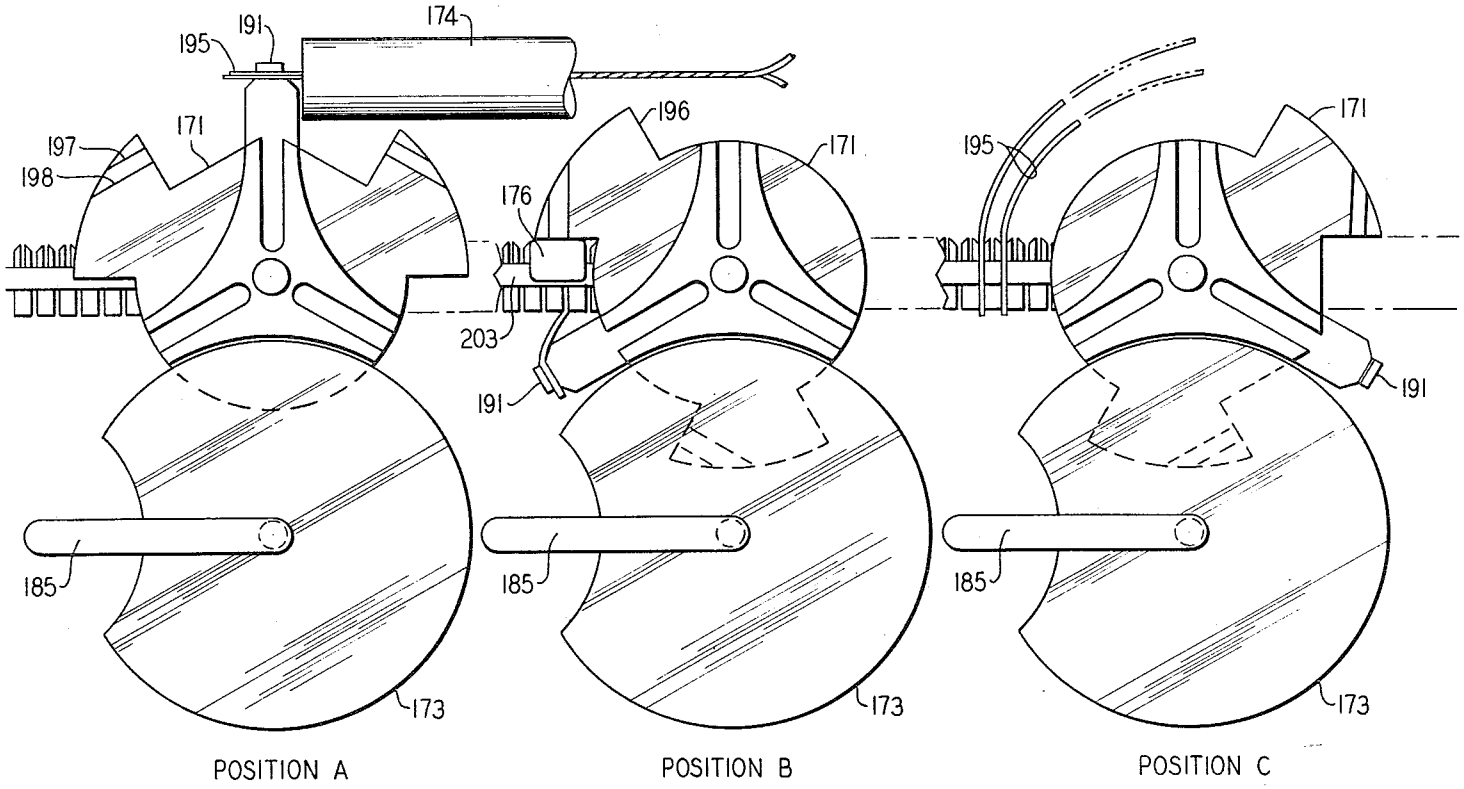
FIG. 8 is a more detailed plan view of the wire handling apparatus showing the three positions of the wire pick-up head.

In order to better understand the wire placement step, a detailed partial view of the placement mechanism at the three positions is shown in FIG. 8. In position A, for example, the wire placement head 171 is in a position to pick up wires 195 from indexing head 174. If driver wheel 173 is rotated one full revolution in a clockwise direction, wire placement head 171 assumes the position shown at position B. It will be noted that the shoulder 196 of wire placement head 171 includes a pair of displaced grooves 197 and 198 which guides wires 195 into laterally displaced positions when wire placement head 171 is in position B. This lateral disposal of the wires of the pair permits a cutter-presser head 176 to force the wires into adjacent slotted-beam connectors. This action can be better seen in FIG. 9 where cutter-presser head 176 includes guideways 230 and 231 which engage the wires 195 and force them into slotted-beam connectors 200 and 201. Presser head 176 also includes a cutter blade 221 (FIG. 15) which severs the wires on one edge 203 of the slotted-beam connector block. The short wire ends remaining in jaws 191 can then be discarded simply by releasing jaws 191 and allowing these cut ends to fall into a waste collection bin, not shown, which is carried on platform 118 of roving actuator 103.

If a bottom connection is required, driver wheel 173 can rotate counterclockwise through one complete revolution, thereby rotating placement head 171 clockwise through a third of a revolution to position C (FIG. 8) to permit a cutter-presser head (175, 176) to complete the connection. Placement head 171 can remain in position B or C until it is again required to pick up wires from indexing head 174 (position A).

Figure 9:
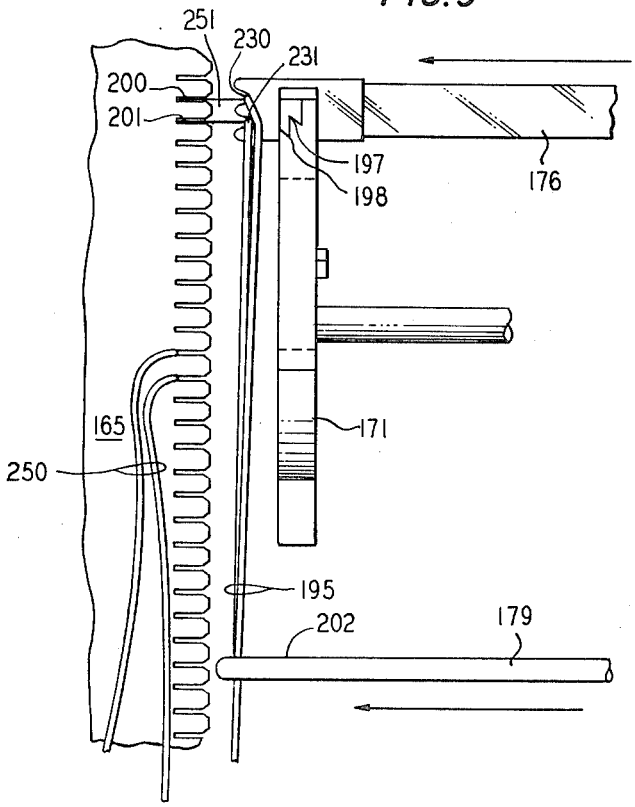
FIG. 9 is an elevation view of the wire pick-up head, presser head and trough insertion tools.

In FIG. 9 there is also shown the trough insertion tool 179 which has a jaw portion 202 at the lower end which can be opened to loosely enclose wires 195. Wires 195 remain free to slide through jaw portion 202. When the trough insertion tool 179 is lowered, it carries wires 195 into the trough 165 (see FIG. 4). A second pair of wires 250 are shown in FIG. 9 as having already been inserted in the trough 165.

Figure 10:
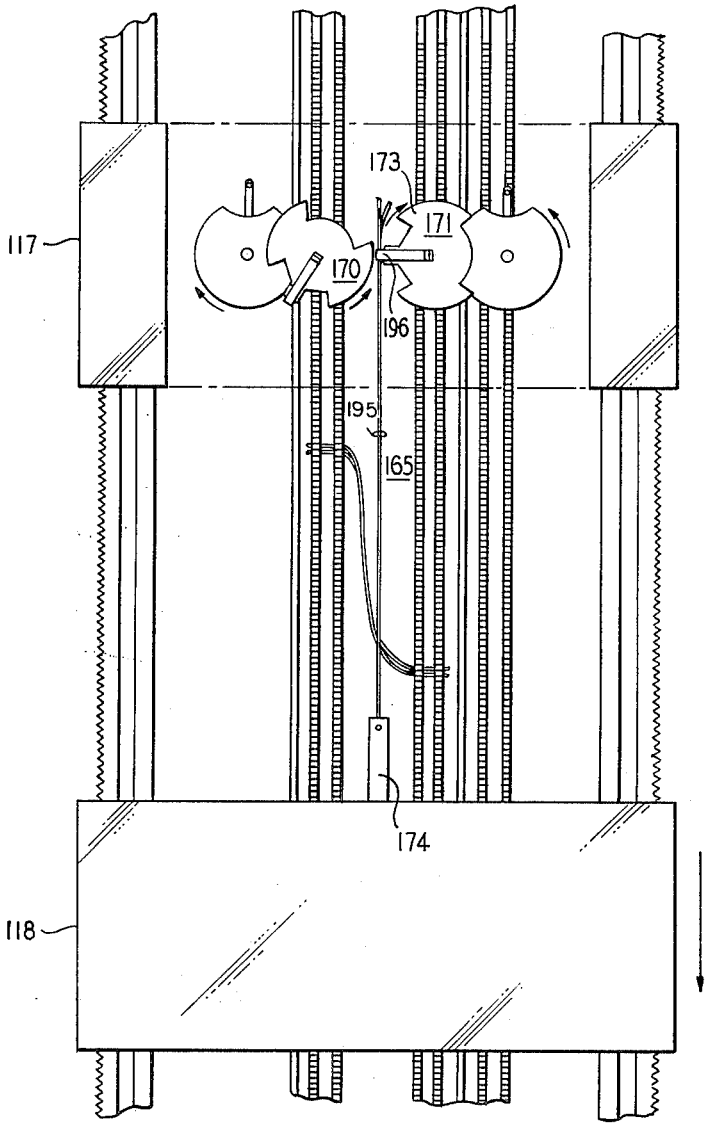
FIGS. 10 and 11 are partial views of the roving actuator of FIG. 6 showing various positions during the jumper placement process.
Figure 11:
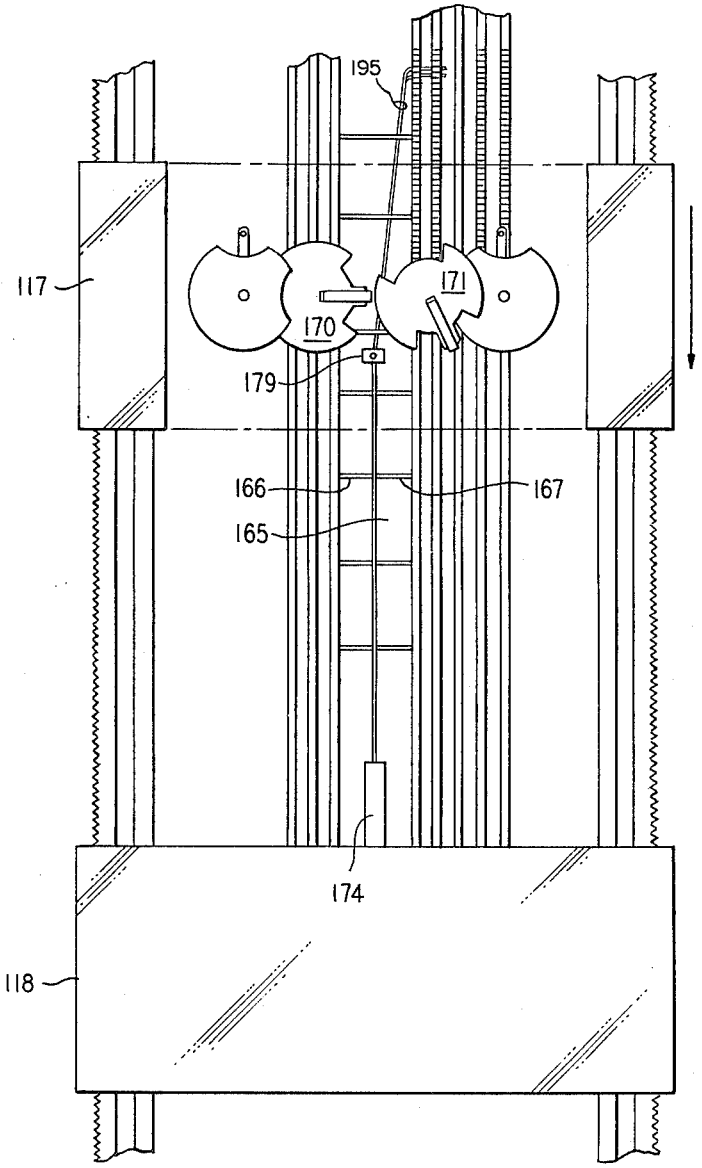

The operation of the wire placement mechanism herein described can be better understood by considering FIGS. 10 and 11. In FIG. 10, for example, it is assumed that platform 117 has already been close to platform 118 and jaws 196 on placement head 173 have picked up wires 195 from indexing head 174. As platform 117 is then raised to the vicinity of the upper connection, wires 195 are payed out from indexing head 174 above trough 165. Platform 117 stops its upward movement when placement head 173 is so placed that a third of a revolution rotation in a clockwise direction will place wires 195 directly opposite the appropriate pair of slotted-beam connectors. As shown in FIGS. 8 and 9, a presser head 176 then makes connections at this upper termination and a trough insertion tool 179 encloses wires 195 and moves wires 195 down into trough 165. As shown in FIG. 11, platform 117 again moves downward. During this downward movement, tool 179 forces wires 195 into trough 165, bending resilient retaining clips 166 and 167 out of the way as tool 179 engages these retaining clips.

When platform 117 is again in the area of the lower jumper termination, it stops and either placement head 171 or placement head 170 is rotated a third of a revolution so as to grasp the other end of wires from indexing head 174. After a slight downward movement of platform 18, cutter blades 180 and 181 operate to cut the wires and permit connection of the lower end of the wires. This cutting operation can be better seen in FIGS. 12 and 13.

Figure 12:
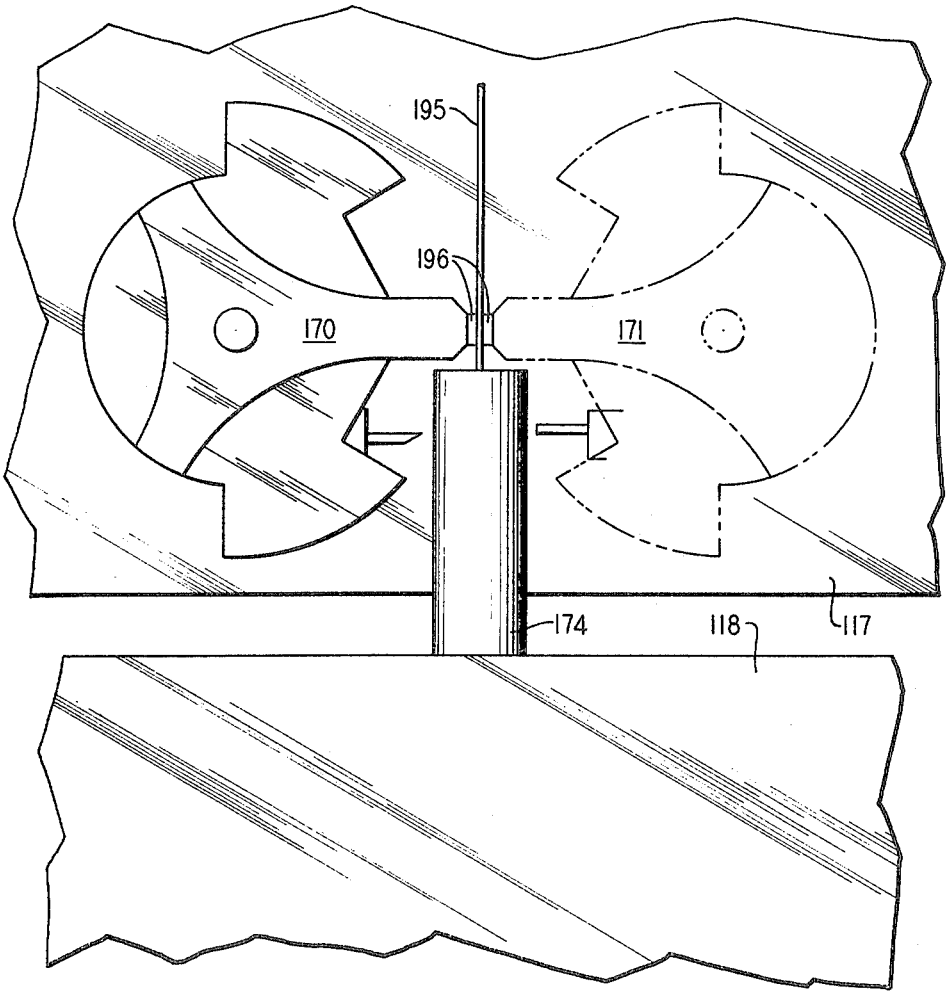
FIGS. 12 and 13 are partial views of the wire pick-up and wire cutting tools in operation.

Referring to FIG. 12, there is shown a more detailed view of the interaction between the indexing head 174, the placement heads 170 and 171 and the cutter blades 180 and 181. In FIG. 12 placement head 170 or 171 has just been rotated to the wire pick-up position and jaws 196 have just been operated to grasp the lower end of wires 195 in the vicinity of indexing head 174. Cutter blades 180 and 181 are retracted in their housings at this time so as to provide adequate clearance for indexing head 174. Immediately after wires 195 are secured in jaws 196, indexing head 174 and platform 118 are moved a short distance downward. Cutter blades 180 and 181 are then operated toward each other to shear wires 195. That is, the end of cutter blade 180 is beveled to provide a sharp cutting edge which is positioned to slide on the surface of blade 181 and thereby shear wires 195 on the shearing surface at the end of blade 181. Blades 180 and 181 can thereafter be retracted and the lower termination made. It will be noted that a short stub 205 of wires 195 remains protruding from indexing head 174. This protruding stub is therefore available to be picked up by jaws 196 to initiate the next jumper placement cycle.

Figure 14:
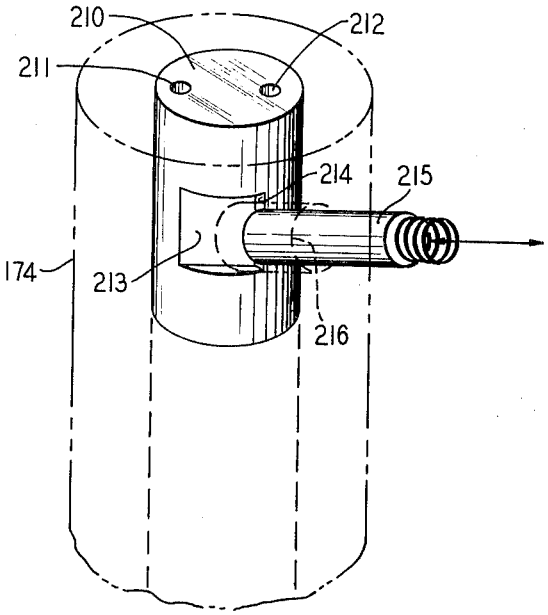
FIG. 14 is a perspective view of a twisted pair wire index head used to supply twisted jumper wires.

In FIG. 14 there is shown a partially cutaway view of indexing head 174 including therein a spinning rotor 210 having a pair of threadways 211 and 212 bored therein. The diameter of threadways 211 and 212 permits the individual wires of a jumper pair to be slidably inserted therethrough. Rotor 210 is rotatably mounted on bearings, not shown, which permit rotor 210 to spin in either direction within head 174. A twisted pair of wires threaded through threadways 211 and 212 can therefore be pulled through rotor 210 such that rotor 210 spins to track the twists in the twisted pair.

Along the outer periphery of rotor 210 is a depressed guideway 213 terminating in a stop 214. If a latching pin 215 is resiliently inserted through an aperture 216 in head 174 into contact with rotor 210, as rotor 210 rotates clockwise latching pin 215 engages guideway 213 and eventually comes against stop 214. At this point, rotor 210 is no longer free to rotate and presents the wires in threadways 211 and 212 in a preferred orientation. This preferred orientation determines which conductor is the tip conductor and which conductor is the ring conductor of the jumper connection. Moreover, the orientation of threadways 211 and 212 are arranged such that jaws 191 on wire placement head 170 or 171 can easily grasp these wires. Latching pin 215 is under the control of a mechanism, not shown, which latches rotor 210 at the appropriate time in the jumper placement cycle and thereafter releases rotor 210 for paying out the next jumper connection.

Figure 15:
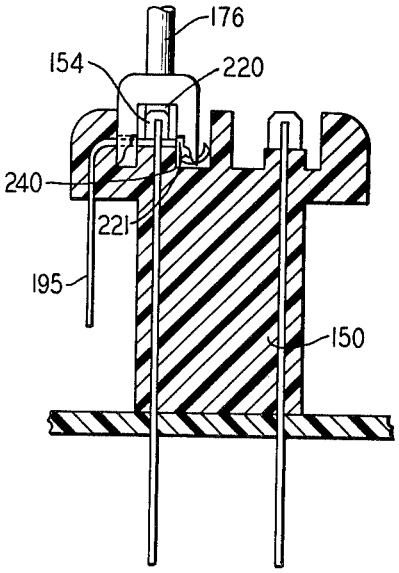
FIG. 15 is a detailed cross-sectional view of the presser-cutter head in contact with the terminal strip.

In FIG. 15 there is shown a partial sectional view of the connector block 150 showing the operation of a cutter-presser head such as head 176, 177, 178 or 179. The cutter-presser head includes an interior cavity 220 of an appropriate size to fit over the top ends of slotted-beam connectors 154. Bearing surfaces on the bottom of head 176 force wires 195 into the slotted-beam connectors and a cutting blade 221 on the interior side of head 176 cuts the wire stubs extending beyond the inner shoulder of block 150. A more detailed description of the cutter-presser head can be found in A. R. Smith U.S. Pat. No. 4,117,585, granted Oct. 3, 1978.

Apparatus has been described which permits the automatic placement of jumper wires between slotted-beam connectors on the face of a main distributing frame in a telephone central office. While such connections are limited to slotted-beam connectors facing on the two sides of a single wire trough, it should be noted that the upper and lower connections can be on the same side or on opposite sides of the same trough. Moreover, by providing multiple appearances of various cable pairs or central office equipments, more than one jumper connection can be made to such multiple appearances. Multiple appearances can be created by cross-wiring the wire wrap posts in the cross-connection field on the inner surface of the main distributing frame 101.

In order to better understand the apparatus and method of the present invention, a jumper placement cycle will now be described in detail. Each wire placement cycle consists of the following steps:

(1) The roving actuator 102 or 103 (FIG. 1 or FIG. 2) moves under the control of computer 104 to position the wire placement mechanisms over a selected vertical trough between two adjacent ones of vertical connector blocks 112.

(2) Platforms 117 and 118 are moved to close together as shown in FIG. 6.

(3) Wire placement head 170 or 171 (depending upon whether the appropriate connection is on the left-hand or the right-hand side of the trough, respectively) is rotated one-third of a revolution (FIG. 7) and places the jaws 196 of the wire placement head in line with the wire stubs protruding from indexing head 174.

(4) Jaws 196 are opened and thereafter closed to grasp the wire ends extending from indexing head 174 (see FIG. 12). At this time, spinning rotor 210 is latched by latching pin 215 from the previous jumper placement cycle (FIG. 14).

(5) Platforms 117 and 118, remaining together, move vertically to a position in the vicinity of the lower end of the jumper connection.

(6) Latching pin 215 is withdrawn from spinning rotor 210, thus permitting rotor 210 to rotate and track twists in the jumper pair.

(7) Upper platform 117 moves upward while lower platform 118 remains fixed in the vicinity of the lower jumper connection. As platform 117 moves upward, the wire pair locked in jaws 196 is carried along with platform 117 and payed out above trough 165. During this pay-out, spinning rotor 210 spins to track the twists in the twisted pair and thereby maintains this twist in the finished jumper connection.

(8) The wire placement head (170 or 171) turns one-third of a revolution to present the wires grasped in jaws 196 to a position above the upper pair of slotted-beam connectors. As head 170 or 171 is rotated, the wires of the pair fall into grooves 197 and 198 (FIG. 8) to provide the precise lateral displacement of these wires which permits them individually to be presented above adjacent ones of the slotted-beam connector openings. The natural drag of the wire feed mechanism serves to maintain the twisted pair sufficiently taut to permit placement head 170 or 171 to perform this function.

(9) One of the presser-cutter heads 176 or 177 descends toward the connector block, forcing each wire of the pair into a different slotted-beam connector. The cutting blade 221 severs the excess wire ends (FIG. 15) and allows them to fall into a waste bin carried at the bottom of the roving actuator 102 or 103.

(10) The wire placement head 170 or 171 can remain in this position until required again to grasp the jumper pair for the next connection.

(11) The jaws 202 of the trough insertion tool 179 open.

(12) Trough insertion tool 179 descends toward the trough, entrapping the wire pair between the open jaws (FIG. 9).

(13) The jaws 202 close around the wires to provide a loose sliding fit which permits the wires to slide within the jaws.

(14) Trough insertion tool 179 continues to descend into the trough to a position just beyond the retaining clips 166 and 167, carrying the wires enclosed in jaws 202 with it.

(15) Upper platform 117 descends on columns 115 and 116 back to the position of the lower platform 118. During this traverse of platform 117, the wires are forced by the trough insertion tool 179 into trough 165. Insertion tool 179 bends the resilient retaining clips 166 and 167 out of the way during this traverse and the retaining clips resiliently return to their closed position once passed by tool 179. The jumper wires are therefore now in trough 165 under retaining clips 166 and 167.

(16) The jaws 202 of trough insertion tool 179 open and tool 179 is raised out of trough 165, leaving the jumper pair in trough 165.

(17) Just before upper platform 117 closes on lower platform 118, locking pin 215 is operated to lock rotor 210 in the preferred orientation. The final movement of upper platform 117 provides sufficient pull on the wire pair to insure rotor 210 continuing to rotate until pin 215 comes to rest against stop 214.

(18) Wire placement head 170 or 171 (depending on whether the lower jumper connection is on the left-hand or the right-hand side of the trough) rotates one-third of a revolution to bring jaws 196 into contact with the wire pair presented in the preferred orientation by the locked spinning rotor 210.

(19) Jaws 196 open and close to grasp the wire pair near indexing head 174 (FIG. 12).

Figure 13:
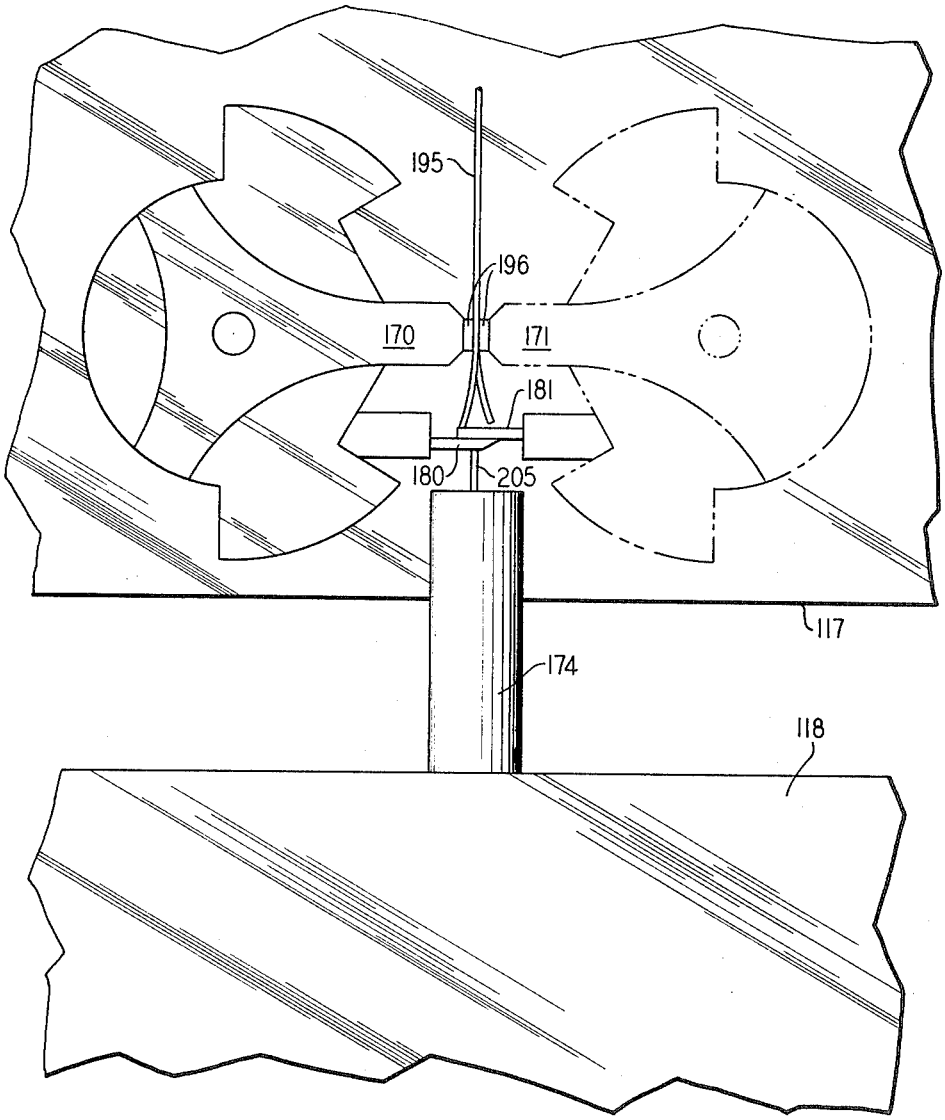

(20) Lower platform 118 descends a small distance to clear cutting blades 180 and 181 and presents the wires to the cutting blades (see FIG. 13). The twist in these wires is sufficiently loose to permit this small movement of indexing head 174 while rotor 210 remains locked.

(21) Cutting blades 180 and 181 operate to sever the wires, leaving a stub extending from the top of indexing head 174 sufficiently long to permit grasping by jaws 196 during the next jumper placement cycle. Spinning rotor 210 remains locked until released during the next jumper placement cycle.

(22) Wire placement head 170 or 171 rotates one-third of a revolution to present the wires above the appropriate lower slotted-beam connectors. Again, the wires are appropriately spread by grooves 197 and 198 to present the two wires to two adjacent slotted-beam connectors. The physical termination at the opposite end of the jumper pair and the resistance of the wires to sliding in the trough provides adequate tension to maintain the wires taut during this operation.

(23) Presser-cutter hed 175 or 176 descends toward the connector block forcing each wire into the aligned slotted-beam connector, the cutting blade 221 cuts the loose ends of the wire at the interior shoulder of the connector block and the loose wires fall into the waste bin. The wire placement head can remain in this position until required again for a future connection. At this point, the jumper connection is complete and platforms 117 and 118 are again moved together in preparation for the next jumper placement cycle.

The various mechanical movements required in carrying out the present invention can be effected by mechanical actuators, not shown. Such mechanical movements can be under the control of mechanical means such as cams and levers, under electrical control by means of electrical solenoids or under hydraulic control by means of controlled valves. In any event, the ultimate control of all of these mechanisms is directed by computer 104 where the detailed sequences of these mechanical operations are specified as electrical signals. Optical or mechanical feedback signals may be generated to insure proper positioning of the more critical moving components of the system.

It is to be understood that the above-described arrangements are merely illustrative of the numerous and varied other arrangements which may constitute applications of the principles of the present invention. Such other arrangements may be readily discerned by those skilled in the art without departing from the spirit and scope of the present invention.

I claim:

1. Automatic apparatus for placing jumper wire connections on a main distributing frame having a plurality of aligned connector blocks with wire troughs therebetween on the face of said frame, said apparatus

CHARACTERIZED BY a rotating wire pick-up head having jaws thereon for grasping jumper wires to be terminated and rotatable from a wire pick-up position to a wire placement position, a source of jumper wires for presenting jumper wire ends to said pick-up head, a wire placement mechanism for securing wires in said jaws in connectors on one of said connector blocks when said pick-up head is in said wire placement position, platform means for moving said pick-up head and said jumper wire source relative to each other and in alignment with said connector blocks, and means for moving said platform means to selected connector blocks on said face of said frame.

2. The apparatus according to claim 1 further CHARACTERIZED BY a trough insertion tool associated with said pick-up head for grasping jumper wires and forcing said grasped jumper wires into said trough.

3. The apparatus according to claim 1 wherein said rotating pick-up head is further CHARACTERIZED IN THAT said head includes two laterally disposed wire separation grooves separated from said jaws by an open space sufficiently large to accommodate said wire placement mechanism, said grooves engaging said jumper wires when said head is rotated from said wire pick-up position to said wire placement position.

4. The apparatus according to claim 3 further CHARACTERIZED BY a geneva movement for driving said wire pick-up head between said wire pick-up position and said wire placement position, said geneva movement comprising a driver wheel having a driver pin disposed peripherally thereon, a groove in said wire pick-up head disposed to engage said driver pin when said driver wheel is rotated, and mating surfaces on said driver wheel and said pick-up head to maintain the axial orientation of said pick-up head except when said pin is engaged in said groove.

5. The apparatus according to claim 3 further CHARACTERIZED BY a second pair of laterally disposed wire separation grooves on the other side of said jaws and likewise separated from said jaws by an open space sufficiently large to accommodate another one of said wire placement mechanisms, and means for rotating said wire pick-up head in either direction to selectively engage said jumper wires in either set of wire separation grooves.

6. The apparatus according to claim 1 wherein said source of jumper wires is further CHARACTERIZED BY a spinning index head including a pair of threadways therein for accommodating the wires of a twisted pair of jumper wires, and means for latching said spinning index head in a preferred orientation to present the wires of said twisted pair in a corresponding preferred orientation.

7. The apparatus according to claim 1 wherein said wire placement mechanism is further CHARACTERIZED BY a cutting blade disposed on said wire placement mechanism so as to cut said jumper wires at said connector block when said wire placement mechanism is brought into contact with said connector block.

8. The apparatus according to claim 1 wherein said platform moving means is CHARACTERIZED BY a roving actuator controllably movable on the face of said main distributing frame in a lateral direction, said roving actuator including a vertical drive mechanism, and means for moving said platform vertically on said roving actuator in response to said vertical drive mechanism.

9. The apparatus according to claim 1 wherein said connector blocks are further CHARACTERIZED BY an insulating connector block body, a plurality of slotted-beam connections disposed in said body to present a slotted-beam at the outer face of said body and a wire wrap post at the inner face of said body, and a plurality of strain relief grooves on said outer face of said body, said grooves being aligned with said slotted beams and disposed to enclose and hold jumper wires when said jumper wires are attached to said slotted beams.

10. The apparatus according to claim 9 further CHARACTERIZED BY at least two line-ups of said slotted-beam connectors disposed on said outer face of said integral block body, an insulated barrier disposed between said connector line-ups, and strain relief grooves for each of said alignments of connectors and disposed on opposite sides of said outer face.

11. The apparatus according to claim 10 further CHARACTERIZED BY at least two of said integral connector block bodies being separated on the outer surface of said main distributing frame to define a trough therebetween for carrying said jumper wires.

12. A wire placement mechanism for aligned slotted-beam connectors CHARACTERIZED BY a rotating wire placement tool having a peripheral jaw portion and a peripheral wire guide groove, a source of wires to be connected between said connectors, means for moving said placement tool to said source to permit said jaw portion to grasp said wires, means for moving said placement tool to the vicinity of the one of said connectors to be connected, means for rotating said placement tool to engage said wires in said groove with a portion of said wire extending between said jaw portion and said groove and registered with said one connector, and a reciprocating wire presser tool for forcing said wire portion into said one connector.

13. The wire placement mechansim according to claim 12 further CHARACTERIZED BY a pin-and-slot geneva driving mechanism for rotating said wire placement tool between a wire grasping position and a wire placement position.

14. A method of making automatic jumper connections between wire-piercing connectors arrayed in parallel vertical lines on the outer face of a main distributing frame, said vertical lines of connectors being separated by jumper wire retaining troughs therebetween, said method CHARACTERIZED BY the steps of (1) moving a jumper wire source to the vicinity of a first connector at one end of a desired jumper connection, (2) pulling a jumper wire vertically from said jumper wire source to the vicinity of a second connector at the other end of said desired jumper connection, said jumper wire lying outside of said retaining trough, (3) moving the pulled end of said jumper wire laterally to a position registered with said second connector, (4) engaging said pulled end of said jumper wire end in said second connector, (5) pushing the jumper wire length from said second connector to the vicinity of said first connector into said trough, (6) severing said jumper wire at said jumper source, (7) moving the severed end of said jumper wire laterally to a position registered with said first connector, and (8) engaging said severed end of said jumper wire in said first connector.

15. The method according to claim 14 wherein said step of pulling a jumper wire is further

CHARACTERIZED BY (9) indexing a pair of twisted jumper wires to present a preferred orientation of the wires of said pair to be pulled.

16. The method according to claim 14 wherein said steps of laterally moving jumper wire ends are further CHARACTERIZED BY the step of rotating said ends in an arc and engaging said wires in positioning grooves to permit registration of the wire portions between said pulled end and said grooves.

17. The method according to claim 14 wherein the steps of engaging are further CHARACTERIZED BY the steps of (9) pushing said registered wires into said wire-piercing connectors, and

(10) simultaneously cutting the ends of said wire extending beyond said connectors.

18. The method according to claim 14 wherein the step of pushing said jumper wire length into said trough is further CHARACTERIZED BY the steps of (9) loosely enclosing said jumper wires in the jaws of a trough insertion tool,

(10) moving said trough insertion tool into said trough, and

(11) moving said trough insertion tool in said trough from the vicinity of said second connector to the vicinity of said first connector.

* * * * *